US012617506B2

(12) United States Patent
Grall

(10) Patent No.: US 12,617,506 B2
(45) Date of Patent: May 5, 2026

(54) DEVICE AND METHOD FOR AUTONOMOUSLY CONTROLLING A BOAT

(71) Applicant: EXAIL, Saint-German-en-Laye (FR)

(72) Inventor: Sébastien Grall, Saint-Germain-en-Laye (FR)

(73) Assignee: EXAIL, Saint-Germain-en-Laye (FR)

( * ) Notice: Subject to any disclaimer, the term of this patent is extended or adjusted under 35 U.S.C. 154(b) by 180 days.

(21) Appl. No.: 18/570,508

(22) PCT Filed: Jun. 14, 2022

(86) PCT No.: PCT/EP2022/066191
§ 371 (c)(1),
(2) Date: Dec. 14, 2023

(87) PCT Pub. No.: WO2022/263453
PCT Pub. Date: Dec. 22, 2022

(65) Prior Publication Data

US 2024/0383585 A1 Nov. 21, 2024

(30) Foreign Application Priority Data

Jun. 15, 2021 (FR) ..... 2106320

(51) Int. Cl.
*B63B 79/40* (2020.01)
*B63B 35/00* (2020.01)
(Continued)

(52) U.S. Cl.
CPC ..... *B63B 79/40* (2020.01); *B63B 35/00* (2013.01); *B63B 79/10* (2020.01); *B63H 21/21* (2013.01); *B63B 2035/007* (2013.01)

(58) Field of Classification Search
CPC ..... B63B 79/40; B63B 35/00; B63B 79/10; B63B 2035/007; B63B 2035/006; B63H 21/21
See application file for complete search history.

(56) References Cited

U.S. PATENT DOCUMENTS 8,798,825 B1 * 8/2014 Hartman ..... B63B 39/061
2013/0020990 A1 * 1/2013 DeBoer ..... B60L 53/305
(Continued)

FOREIGN PATENT DOCUMENTS

CN 207374608 * 5/2017 ..... Y02A 20/204
CN 207764652 * 12/2017 ..... G05D 1/02
(Continued)

OTHER PUBLICATIONS

International Search Report for PCT/EP2022/066191 mailed Aug. 9, 2022, 4 pages.
(Continued)

*Primary Examiner* — Brodie J Follman
(74) *Attorney, Agent, or Firm* — NIXON & VANDERHYE

(57) ABSTRACT

This relates to a control device for a boat, including members which provides steering, propulsion and safety functions for the boat. The control device includes: sensors; —a central processing unit; at least two peripheral modules which are associated with the member and which each include an interface for receiving data from the sensors; an interface for controlling the member associated therewith; a processing unit; and an interface for communicating with the central processing unit. The processing unit and the central processing unit are programmed to generate instructions for driving the member.

15 Claims, 2 Drawing Sheets

(51) Int. Cl.
*B63B 79/10* (2020.01)
*B63H 21/21* (2006.01)

(56) References Cited

U.S. PATENT DOCUMENTS

| | | | | |
|---|---|---|---|---|
| 2015/0089427 | A1* | 3/2015 | Akuzawa | G05D 1/0206 |
| 2020/0050893 | A1* | 2/2020 | Suresh | G05D 1/0206 |
| 2020/0398954 | A1* | 12/2020 | Solberg | B63B 79/10 |
| 2023/0001797 | A1* | 1/2023 | Makio | H02J 7/0019 |

FOREIGN PATENT DOCUMENTS

| | | | | |
|---|---|---|---|---|
| CN | 207764652 | U * | 8/2018 | |
| CN | 109250031 | A | 1/2019 | |
| CN | 212034354 | * | 11/2020 | H04W 4/48 |
| WO | 2007047615 | A2 | 4/2007 | |
| WO | 2019172774 | A1 | 9/2019 | |

OTHER PUBLICATIONS

Written Opinion of the ISA for PCT/EP2022/066191 mailed Aug. 9, 2022, 7 pages.

* cited by examiner

DEVICE AND METHOD FOR AUTONOMOUSLY CONTROLLING A BOAT

CROSS-REFERENCE TO RELATED APPLICATIONS

This application is the U.S. national phase of International Application No. PCT/EP2022/066191 filed Jun. 14, 2022 which designated the U.S. and claims priority to FR 2106320 filed Jun. 15, 2021, the entire contents of each of which are hereby incorporated by reference.

TECHNICAL FIELD OF THE INVENTION

The present invention generally relates to boat field.

More particularly, it relates to a control device to be installed in a boat, which comprises members providing steering, propulsion and safety functions.

The invention finds a particularly advantageously application in the implementation of autonomous control means in existing ships, although it also applies to the manufacture of new ships.

The invention also relates to a boat equipped with such a control device, as well as a method for controlling such a boat.

STATE OF THE ART

Rather conventionally, a boat comprises different propulsion, steering and safety members, such as motors, pumps, fans . . . .

Beyond a certain size, a boat also includes a cockpit, from which it is possible to control these members and in which are provided member operating and malfunction warning indicators. Thanks to these indicators, it is possible to determine the location of any malfunction, which enables a quick intervention to remedy the problem.

It is currently sought to market boats having semi-autonomous or fully autonomous control functions.

It is therefore known to manufacture autonomous boats, also called drone-ships.

It is also known to equip boats having already sailed, and initially devoid of such autonomous functions, with means enabling them to be autonomous.

Such means are expensive to manufacture, and are also very costly to implement because such boats have not been designed to enable the integration of such means and the connection thereof to the already-existing systems.

The greater the number of elements to be installed in a boat to make it autonomous, the greater the complexity.

To fully understand the complexity of automating a boat, any one of the members of this boat can be considered, for example the bilge pump thereof.

On a non-autonomous boat, a simple power light indicator is provided for detecting a potential malfunction. Another indicator can be provided to detect an abnormal level of liquid in the bilge.

On the contrary, on an autonomous boat, these only indicators are no longer sufficient. It is indeed understood that, in case of malfunction, it is at least necessary to determine the malfunction origin and the impact on the boat safety. Therefore, many sensors have to be installed in areas that have not been designed for that purpose, then connected through the boat walls.

This problem of sensor implementation and connexion also exists, albeit to a lesser extent, in the context of manufacture of new drone-boats.

DISCLOSURE OF THE INVENTION

In order to remedy the above-mentioned drawbacks of the state of the art, the present invention proposes a control device for boat members, including:

- sensors adapted to measure parameters relating to the operation of at least two of said members,
- a central unit,
- at least two peripheral modules each associated with one of said at least two members.

According to the invention, each peripheral module comprises:

- a measurement interface adapted to receive data coming from part at least of the sensors,
- a control interface adapted to issue control instructions for the member associate therewith,
- a unit for processing the received data, and
- a communication interface adapted to communicate with the central unit.

Also according to the invention, the processing unit is programmed to generate first control instructions for the member associated therewith and to elaborate processed information to be transmitted to the central unit, as a function of the received data, whereas the central unit is programmed to generate second control instructions for the member as a function of the processed information elaborated by the processing units of said at least two peripheral modules.

Therefore, the invention proposes a unit that is easily connectable and directly usable ("plug and play") both in an old boat and in a new boat, in order to provide it with autonomous or semi-autonomous evolution capabilities.

The use of a central unit and of semi-autonomous peripheral modules enables a sharing of the control tasks between two distinct levels (high level and low level).

This makes it possible to place the sensor data processing function as close as possible to the relevant member (low level) and to provide the central unit with already processed and centralized information (high level). The central unit job is therefore made easier.

The measured data being thus processed close to the relevant member, the quantity of data transmitted to the central unit and the quantity of cables required for this transmission are limited. This facilitates the implementation of the control system in a boat, in particular when the matter is to pass the cables through watertight partitions.

The use of peripheral modules further enables standardizing the information processing for each member, which makes it possible to reduce the manufacturing costs for the components required for making boats autonomous.

It moreover enables standardizing the control laws. In this context, the use of artificial intelligence will enable in particular natural adaptation of this control law to the specific features of each member.

Finally, this architecture makes it easier to qualify a function in terms of regulations.

It will moreover be noted that sharing the tasks between two high and low levels offers a good safety to the boat, because it offers service continuity even if one of the components malfunctions.

It will be noted that, preferentially, a member being adapted to perform only one function (pumping, motorization, steering . . . ), each member will be equipped with its own peripheral module.

It will also be noted that the central unit and the peripheral module can possibly transmit instructions for the same member.

In this respect, these instructions may relate to different functions of the members (control of different actuators of the member . . . ), but as an alternative, these instructions could apply to a same function of the member. In this case, the peripheral module will for example be used to generate the instructions in standard mode, and the central unit will be used to generate them only when needed.

Other non-limiting and advantageous features of the device according to the invention, taken individually or according to all the technically possible combinations, are the following:

- said at least two members provide different functions;
- the processing units of the peripheral modules are physically identical;
- the peripheral modules are physically identical;
- the communication interface of each peripheral module includes a terminal block for connection to an electrical or optical conductor, which makes it possible to receive signals from the central unit;
- the communication interface of each peripheral module includes a radio chip, for transmitting radio signals to the central unit;
- one at least of the peripheral modules includes a cutting means for interrupting the power supply to the member with which it is associated and which is controlled by the processing unit according to the first control instructions;
- a first part at least of the sensors is located outside the peripheral modules;
- said first part of the sensors comprises at least one of the following components: flow meter, pressure sensor, tachometer, hydrocarbon detector, accelerometer, temperature sensor, dry contact, liquid level detector;
- part at least of the sensors is located inside the peripheral modules;
- said part of the sensors comprises at least one of the following components: a current sensor and/or a voltage sensor, an accelerometer, a temperature sensor;
- one at least of the two members of the boat is included in the following list: a bilge pump, a fan, a fire circuit pump, a fuel supply circuit component or fuel supply circuit, a cooling circuit component or cooling circuit, a hydraulic circuit component or hydraulic circuit, a sea water filter;
- the central unit is connected to a display screen and is programmed to transmit data to the display screen as a function of the processed information;
- the processing unit of one at least of the peripheral modules stores a control law for a member with which it is associated and an artificial intelligence self-learning algorithm, for changing said control law as a function of the received data.

The invention also relates to a boat having a shell that houses members providing steering, propulsion and safety functions for the boat, said boat including a control device as mentioned hereinabove.

The invention also relates to a method for controlling a boat, comprising the steps of:

- measuring parameters relating to the operation of at least two members by means of sensors,
- receiving data coming from the sensors through the measurement interfaces of the peripheral modules associated with said at least two members,
- processing the received data using the processing unit of each peripheral module to generate a first control instruction and to elaborate processed information,
- transmitting the first control instruction to the member with which each peripheral module is associated,
- transmitting the information processed by the processing units of the peripheral modules to the central unit,
- reprocessing the processed information using the central unit to generate second control instructions,
- transmitting the second control instructions to the peripheral modules, and
- transmitting the second control instructions from said peripheral modules to the members with which they are associated.

Obviously, the different features, alternatives and embodiments of the invention can be associated with each other according to various combinations, insofar as they are not incompatible or exclusive with respect to each other.

DETAILED DESCRIPTION OF THE INVENTION

The following description in relation with the appended drawings, given by way of non-limiting examples, will allow a good understanding of what the invention consists of and of how it can be implemented.

Figure 1:
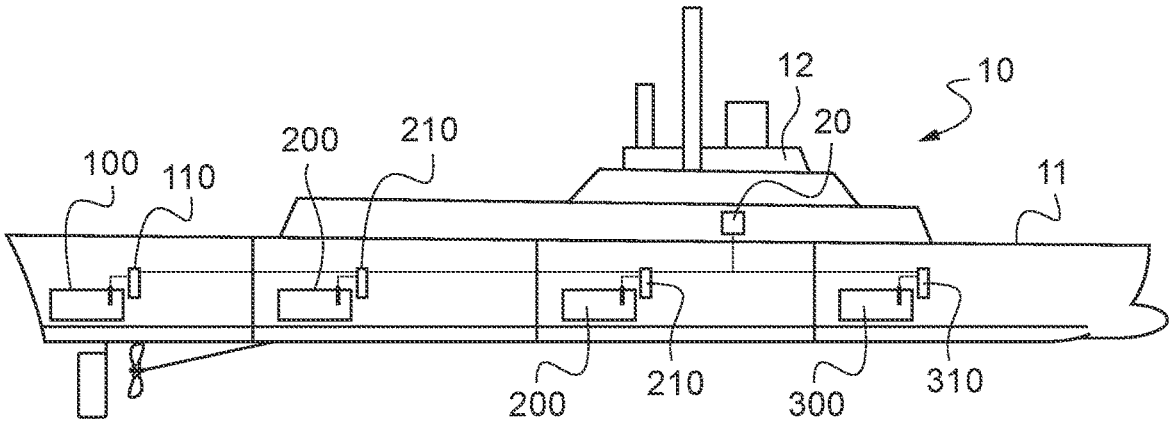
FIG. 1 is a schematic view of a ship equipped with a control device according to the invention comprising a central unit and peripheral modules.

In FIG. 1 is shown, in side view, a boat, and more precisely a ship 10, adapted to sail on open seas.

This ship 10 conventionally includes a shell 11 topped which a superstructure within which is located a bridge 12 (or wheelhouse).

The ship 10 includes various electrically-operated members for providing a wide range of functions, such as the propulsion, steering, safety thereof, as well as, possibly, other functions such as pleasure or work functions.

Such a member may comprise or be formed of an electromechanical or electropneumatic or electrohydraulic device.

In the following of the description, for the sake of clarity, members will be considered, which are each adapted to perform a well-identified function in the ship 10. Among these members, only some of them will be referenced in the figures, for the sake of clarity of these latter.

The number of members and functions may vary from a ship to another. It is considered here that the ship 10 includes the following members:

- a power unit providing a function of propelling the ship 10,
- a bilge pump circuit 200 providing a waterway detection and dewatering function,
- a ventilation system providing a function of air renewal in the boat,
- a fire pump providing a fire-fighting function,
- a fuel system 300 providing a function of fuel supply to the power unit,
- an opening detection circuit for detecting any watertight door opening in the ship,
- a cooling circuit for cooling the power unit,
- a tachometer system for measuring the rotational speed of the power unit output shafts, a filtration system providing a function of filtering the sea water, and a hydraulic circuit 100 for, in particular, pivoting the steering system, and therefore the rudder(s), of the ship.

In the present disclosure, each of these members and each of these functions are to be automated. The ship 10 shown in FIG. 1 is indeed autonomous in that it is designed to move along a predefined route without human intervention. As an alternative, it could be semi-autonomous in that only part of the above-mentioned functions are automated.

Obviously, as another alternative, any other member for providing any useful function in the ship could also be automated in the same way.

In order for it to be automated, the ship 10 carries a control system that is thus provided to control all the members thereof.

The control system which is the subject of the present invention has two control levels, a high lever with a central unit 20, and a low level with semi-autonomous peripheral modules 110, 210, 310, each associated with one of the distinct members 100, 200, 300 of the ship 10.

The central unit 20 includes one or several processors, one or several memories, and one or several communication interfaces.

In the following of the description, it will be considered that it includes only a processor, a memory and a communication interface, and that it is adapted to process the information coming from all the peripheral modules 110, 210, 310 of the ship 10. In other words, it will be considered that this single central unit 20 makes it possible to control all the above-mentioned members 100, 200, 300 of the ship.

As an alternative, it could be provided that the central unit includes different entities, independent from each other or connected to each other, each adapted to process the information coming from part of the ship peripheral modules.

Thanks to its communication interface, the central unit 20 is adapted to receive as an input data coming from the peripheral modules and to output instructions to these same modules. It is further adapted to control the display of information on display screen located in the bridge 12 of the ship 10, in such a way that the person present can read it. As an alternative, these screens could be located in a shore-based control centre, especially if no human is on board the ship 10.

Thanks to its memory, the central unit 20 stores a computer application, consisted of computer programs comprising instructions whose execution by the processor enables the implementation by the central unit 20 of the method described hereinafter.

The peripheral modules 110, 210, 310 equipping the different members 100, 200, 300 are preferably all physically identical.

In other words, they all include the same components, although these latter can be programmed in a different manner.

In the following of the description, only one of these peripheral modules 210 will thus be described, and is shown in detail in FIG. 2.

As shown, this peripheral module 210 is associated with one of the bilge pumps 200 of the bilge pump circuit (this circuit being here considered as carrying several pumps located in different compartments).

Figure 2:
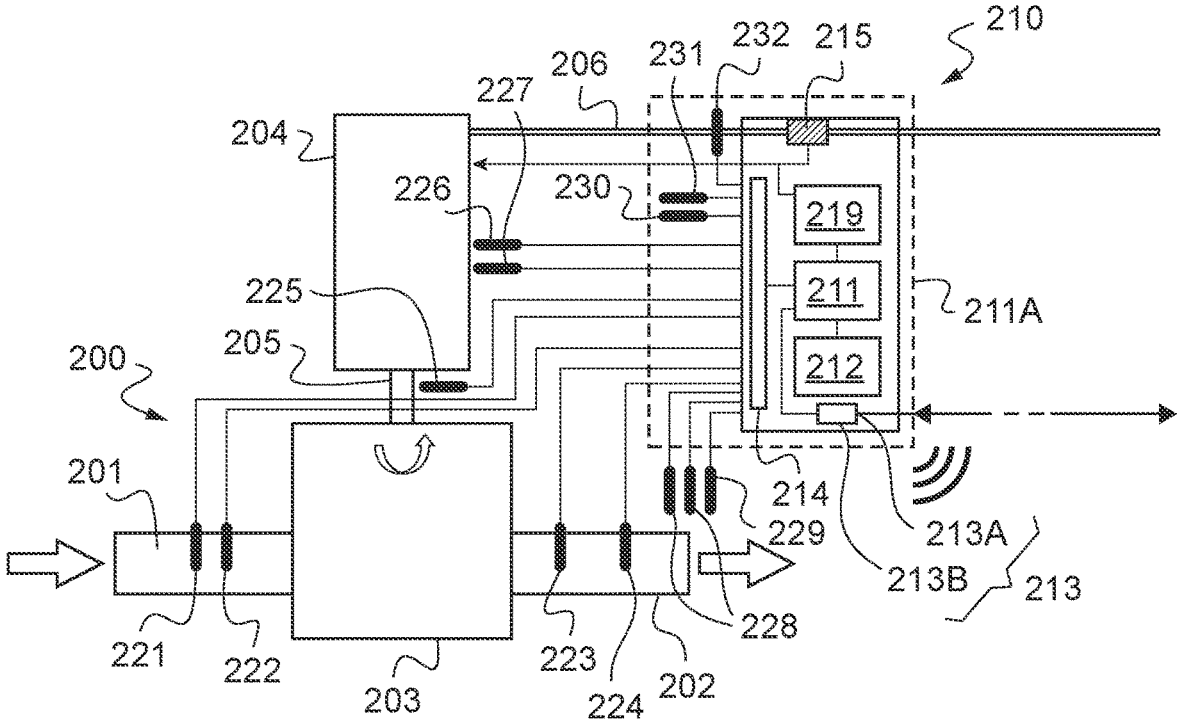
FIG. 2 is a schematic view of a ship member and a peripheral module of FIG. 1 associated with this member.

As shown in FIG. 2, the bilge pump 200 includes a pumping module 203 actuated by an electric motor 204, via a drive shaft 205. It has an inlet hole connected to an inlet pipe 201 for sucking up the bilge water of the ship 10, and an outlet hole connected to an outlet pipe 202 for rejecting the sucked up water out of the ship 10.

The peripheral module 210 associated with this bilge pump 200 includes for its part a casing 211A equipped with attachment means (not shown) for attaching the casing to the structure of the ship 10. By way of example, these attachment means can be in the form of holes for screwing the casing to a wall of the ship 10.

The casing 211A is watertight (with a tightness level greater than or equal to IP23).

Here, the casing 211A first houses a relay 215 that is connected to the electric power wire 206 of the electric motor 204 of the bilge pump 200 and that makes it possible, when needed, to open the power supply circuit for this electric motor 204.

The casing 211A also houses other components, in particular a printed circuit power supplied via the electric power wire 206.

This printed circuit includes different elements, in particular a computer unit 211 for processing data, a control interface 219 adapted to transmit control instructions to the bilge pump 200, a measurement interface 214 adapted to read the data coming from sensors and a communication interface 213 adapted to communicate with the central unit 20.

The processing unit 211 is for example in the form of a processor connected to a memory 212.

Here, thanks to its memory 212, the processing unit 211 stores a computer application, consisted of computer programs comprising instructions whose execution by the processor enables the implementation of the method described hereinafter.

As an alternative, the processing unit 211 could be formed by a programmable logic circuit, whose logic gates would be "programmed" to implement this method.

The control interface 219 is preferably a wire interface, for transmitting the control instructions to the bilge pump 200 and the relay 215 of this pump. In practice, thanks to this interface 219, the peripheral module 210 can transmit start and stop instructions to the electric motor 204 of the bilge pump 200, as well as operating speed instructions.

The communication interface 213 preferably comprises two parts. Here, it includes a terminal block 213A through which it is adapted to communicate with the central unit 20, preferentially to receive data from the latter. It also includes a radio chip 213B and an antenna through which it is adapted to communicate with the central unit 20, preferentially to transmit data to it.

In other words, the communication interface 213 is provided to use radio signals to send information to the central unit 20, and a wire network to collect instructions from this central unit 20.

Therefore, the communication interface of the central unit 20 will also be equipped with a radio chip as well as a wire connection terminal blocks.

The radio communication protocol used will preferably be a low consumption protocol such as Zigbee®, Z-Wave®, Bluetooth®, LoRa® . . . .

Preferably, the radio chips 213B of the different peripheral modules 110, 210, 310 can communicate together, in such a way that, if one of them is unable to transmit or receive data from the central unit 20, another one may serve as a relay for the communication.

Also preferably, the connection terminal block 213A of the communication interface 213 will be connected to a data communication network, such as a data BUS, in order to enable the communication between the central unit and all the peripheral modules.

The measurement interface 214 includes many connection ports through which it is connected to many sensors on board the ship 10.

These sensors include sensors located outside the casing 211A and internal sensors housed inside the casing 211A.

The internal sensors are here four in number.

Therefore, the casing 211A houses a current sensor and a voltage sensor 232 for determining the voltage across the electric motor 204 and the supply current intensity thereof.

It also houses an accelerometer 230 for measuring the intensity and frequency of the vibrations to which the casing 211A is subjected. Finally, it houses a temperature sensor 231 for measuring the air temperature inside the casing 211A.

As an alternative, the casing 211A could house more or less sensors. It could for example be devoid of temperature sensor and accelerometer.

If the internal sensors of the different peripheral modules 110, 210, 310 of the ship 10 are all identical, the external sensor used can vary from a module to another.

In the example illustrated in FIG. 2, in which the member is a bilge pump 200, the external sensors used are the following.

First, a flow meter 224 is provided for determining the flow rate of the fluid sucked up by the bilge pump 200.

Two pressure sensors 222, 223 are also provided, located respectively in the inlet pipe 201 and the outlet pipe 202 of the bilge pump 200.

A tachometer 225 is also used to measure the rotational speed of the electric motor 204.

A hydrocarbon detector 221 placed in either one of the inlet pipe 201 and the outlet pipe 202 enables detecting a potential presence of hydrocarbon in the fluid sucked up by the bilge pump 200.

An accelerometer 226 enables measuring the intensity and frequency of the vibrations to which the pump is subjected, which makes it possible to detect any abnormal vibration of the latter.

A temperature sensor 227 enables determining the temperature of the electric motor 204.

Two dry contact sensors 228 enable detecting the presence of fluid in two distinct areas of the compartment in which the bilge pump is installed.

Finally, a liquid level detector 229 enables measuring the height of fluid in the compartment.

It is then understood that the casing 211A includes openings for the passage of electric wires that connect the sensors to the different ports of the measurement interface 214.

Now that the control system has been described, the way this control device operates for autonomously controlling the members of the ship 10 will be described.

To sum up, each peripheral module 110, 210, 310 supports simple control operations (without the help of the central unit), in particular electric protection of the member with which it is associated. The central unit supports the more complex operations, in particular those which require control coordination between the different members of the ship 10.

Each peripheral module processes for that purpose the data coming from the internal and external sensors in order to generate compiled information, which is then transmitted to the central unit 20. The latter is then able to communicate this information to the bridge, via the display screens. Moreover, it is adapted to return new instructions to the ship members, via the peripheral modules.

The method is here implemented in a loop, in the same way by all the peripheral modules. This method will now be described in detail.

Figure 3:
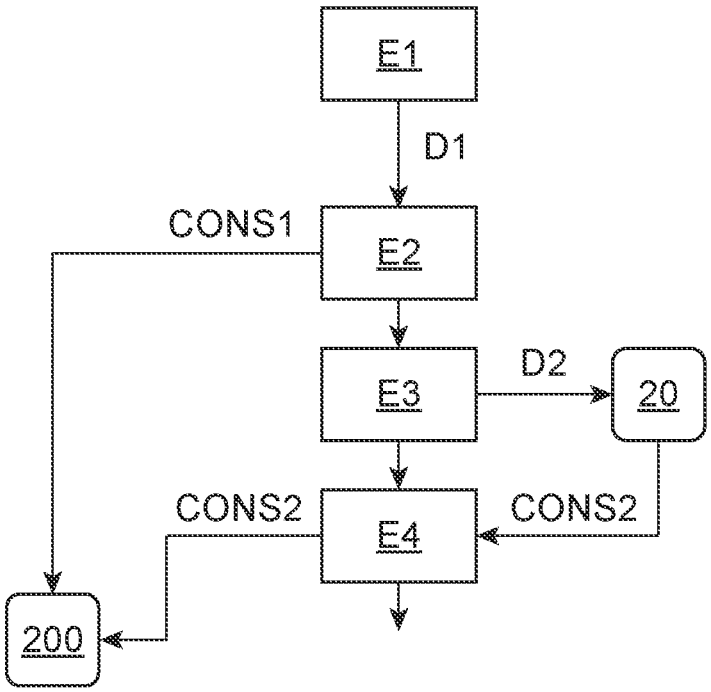
FIG. 3 is a diagram illustrating the steps implemented by the peripheral module of FIG. 2 to control the member associated therewith.

As shown in FIG. 3, in a first step E1, the processing unit 211 of the peripheral module considered (in our example, the module associated with the bilge pump 200) acquires the values of the parameters measured by the internal and external sensors 221 to 232 (acceleration, temperature, liquid level . . . ).

All these parameters relate to the operation of the bilge pump 200 in that their values provide information about:

- the good operation of this pump (is the pressure difference upstream and downstream from the pump normal? is the temperature in a usual interval? . . . ), and
- the external conditions affecting the pump operation (is the liquid level to be pumped abnormally high? is fuel detected in the sucked-up liquid? . . . ).

These values, hereinafter called "measurement data D1", are then received by the processing unit 211 via the measurement interface 214 of the peripheral module 210.

Thereafter, during a second step E2, then a third step E3, these measurement data D1 are processed by the processing unit 211.

In the second step E2, the processing unit generates so-called low-level, simple instructions, making it possible to influence the bilge pump operation. Here, the idea is to generate control instructions for this pump as close as possible to the latter, in order to avoid the transit of a great number of data towards the central unit 20, whereas these data can be processed rapidly by the peripheral module 210.

For that purpose, the processing unit 211 integrates a control law that receives at least measurement data as an input, and outputs a first control instruction CONS1.

This first control instruction CONS1 thus exclusively depends on the measurement data D1 values.

By way of illustration, the processing unit 211 receives as an input the voltage measured across the electric motor 204 of the bilge pump 200. If this voltage is in a nominal interval, the processing unit generates no particular instruction. In the opposite case, the first control instruction CONS1 comprises an instruction for opening the relay 215.

It will be noted here that the relay 215 can also be controlled by the central unit 20 or by a manual control means, typically via a manual safety button, if needed.

By way of another example, starting the bilge pump 200 in case water is detected, triggering an alarm in case of pump malfunction or abnormal water level rising, can be autonomously operated by the processing unit 211.

The control law used here is programmed upstream from the control unit 211 and integrated into the latter. It integrates in particular thresholds (for voltage, water level . . . ) that are previously determined and invariable.

As an alternative, this control law may not be immutable. An artificial intelligence self-learning, based on the measurement data and high-level responses (by the central unit and by human operators, on board or not). That way, the control unit 211 could in particular adjust the threshold values in order to control more finely the member that is associated therewith, without the control unit or the operator has to intervene. In other words, the thresholds can be adjusted in such a way as not to exceed the limits beyond which the central unit or an operator will have to intervene.

The self-learning could for example be made using an artificial neural network, the input data D1 and the control instructions CONS1, CONS2 being provided at the input of this artificial neural network and the applicable thresholds being obtained at the output of this artificial neural network.

In practice, the learning of this neural network can be made during the building of the boat 10. However, it will preferably be made during the boat operation, which will enable the central unit and the operators to intervene less and less often in the control of the bilge pump 200. One interest of this solution is that the thresholds can be adjusted differently from a ship to another (even if they are identical ships or "sisterships"), in order to be adapted to the specific features of the ship 10. Another interest of this solution is that the peripheral modules installed on members of different types can initially be programmed in the same way, the adaptation of these modules being made over time.

During step E3, the processing unit 211 processes the measurement data D1 in order to elaborate "processed information D2" to be sent to the central unit 20.

For that purpose, the processing unit 211 of the peripheral module 210 integrates a data transformation algorithm that receives as an input part at least of the measurement data D1 and that outputs the processed information D2.

Here, the idea is to concatenate the relevant measurement data D1 before sending them to the central unit 20, in order to minimize the passband required for sending these data.

By way of example, this data transformation algorithm can be programmed to concatenate only the values of the parameters that are out of the predefined intervals.

At the end of this step E3, the processed information D2 is transmitted to the central unit 20.

This processed information D2 is then read by this central unit 20, which is then programmed to perform three actions.

The first action consists in controlling the display of the interesting data on the display screens present at the bridge of the boat 10.

By way of example, the screens can be controlled to display a message such as "Pumps OK" if no malfunction is detected, and to display a different message in the opposite case. In this event, the displayed message will preferably enable the operator to correctly identify the type of malfunction met by the bilge pump 200.

The second action consists, if needed, in emitting messages outside the boat 10, for example distress messages or information messages to ships in its area of operation. Such a message can for example be emitted if the level of liquid in one or several compartments exceeds an alert threshold.

The third action consists for the central unit 20 to elaborate a second control instruction CONS2 to be transmitted to the bilge pump 200, via the peripheral module 210 associated with this pump.

This second control instruction CONS2 thus depends on the values of the processed information D2 that have been received from all the peripheral modules 110, 210, 310.

By way of example, taking into account the processed information D2 received from all the peripheral modules 110, 210, 310, the central unit 20 can decide to secure the ship 10 or to stop the mission. For example, in case of failure of the engine's fuel injection system, the central unit 20 can decide to stop all the members of the ship 10 other than the safety members, such as the bilge pumps.

In this case, the central unit 20 is programmed to transmit control instructions CONS2 to all the members, via their peripheral modules.

Therefore, at step E4, when the peripheral module 210 receives a second control instruction CONS2, it is programmed to apply it even if the latter contradicts the first control instruction CONS1.

In the above description, focus has mainly be placed on the bilge pumps.

As mentioned above, all the other members of the ship 10 could be controlled in the same way.

By way of example, the ventilation system and the method for controlling same will now be described briefly.

This system here comprises a main fan and an emergency fan. Sensors can measure the rotational speed of each of these fans, the pressure difference upstream and downstream the main fan, the ventilated air temperature . . . .

Thanks to these measurement data, the processing unit of the peripheral module associated with this ventilation system can detect an obstruction and locate the position thereof (upstream or downstream from the main fan). It is also able to trigger a suitable alarm and to power on the emergency fan. The analysis of its vibration also informs the peripheral module about the state of the fans.

For this member, the fan speed can be controlled at low level, by the processing unit, as a function of the compartment temperature. It can also be reduced as needed by the central unit, for example in case the ship 10 is secured.

The present invention is not in any way limited to the embodiments described and shown, but the person skilled in the art will know how to apply any variant in accordance with the invention.

By way of example, several references of peripheral modules, with different number of ports, could be provided. Therefore, peripheral modules of different references can be used within a same ship, in order to control different members, the reference used for each member depending on the number of sensors required.

In this ship, modules of same references will preferentially always be used. By way or example, when the ship carries several bilge pumps, the peripheral modules associated with these bilge pumps will all be strictly identical.

The invention claimed is:

1. A control device for a boat, that comprises members providing steering, propulsion and safety functions for the boat, including:

sensors adapted to measure parameters relating to the operation of at least two of said members, a central unit, at least two peripheral modules each associated with one of said at least two members, and that each comprise:

a measurement interface adapted to receive data coming from part at least one of the sensors, a control interface adapted to issue control instructions for the member that is associated therewith, a unit for processing the received data, and a communication interface adapted to communicate with the central unit, wherein the processing unit is programmed to generate first control instructions for the member associated therewith and to elaborate processed information to be transmitted to the central unit, as a function of the received data, and wherein the central unit is programmed to generate second control instructions for the member as a function of the processed information elaborated by the processing units of said at least two peripheral modules.

2. The control device according to claim 1, wherein said at least two members provide different functions.

3. The control device according to claim 1, wherein the processing units of the peripheral modules are physically identical.

4. The control device according to claim 3, wherein the peripheral modules are physically identical.

5. The control device according to claim 1, wherein the communication interface of each peripheral module includes a terminal block for connection to an electrical or optical conductor, which makes it possible to receive signals from the central unit.

6. The control device according to claim 1, wherein the communication interface of each peripheral module includes a radio chip for transmitting radio signals to the central unit.

7. The control device according to claim 1, wherein one at least of the peripheral modules includes a cutting means for interrupting the power supply to the member with which it is associated and which is controlled by the processing unit according to the first control instructions.

8. The control device according to claim 1, wherein a first one of the sensors is located outside the peripheral modules.

9. The control device according to claim 8, wherein said first one of the sensors comprises at least one of the following components:

a flow meter,
a pressure sensor,
a tachometer,
a hydrocarbon detector,
an accelerometer,
a temperature sensor,
a dry contact,
a liquid level detector.

10. The control device according to claim 1, wherein at least one of the sensors is located inside the peripheral modules.

11. The control device according to claim 10, wherein said one of the sensors comprises at least one of the following components:

a current sensor or a voltage sensor,
an accelerometer,
a temperature sensor.

12. The control device according to claim 1, wherein one at least of the two members is:

a bilge pump,
a fan,
a fire circuit pump,
a fuel supply circuit component or fuel supply circuit,
a cooling circuit component or cooling circuit,
a hydraulic circuit component or hydraulic circuit, or
a sea water filter.

13. The control device according to claim 1, wherein the central unit is connected to a display screen and is programmed to transmit data to the display screen as a function of the processed information.

14. A boat having a shell that houses members providing steering, propulsion and safety functions for the boat, wherein the boat includes a control device according to claim 1.

15. A method for controlling a boat according to claim 14, comprising steps of:

measuring parameters relating to the operation of at least two members by means of sensors,
receiving data coming from the sensors through the measurement interfaces of the peripheral modules associated with said at least two members,
processing the received data using the processing unit of each peripheral module to generate a first control instruction and to elaborate processed information,
transmitting the first control instruction to the member with which each peripheral module is associated,
transmitting the information processed by the processing units of the peripheral modules to the central unit,
reprocessing the processed information using the central unit to generate second control instructions,
transmitting the second control instructions to the peripheral modules, and
transmitting the second control instructions from said peripheral modules to the members with which they are associated.

* * * * *